US007487562B2

(12) United States Patent
Frondorf et al.

(10) Patent No.: US 7,487,562 B2
(45) Date of Patent: Feb. 10, 2009

(54) HOSPITAL BED HAVING HEAD ANGLE ALARM

(75) Inventors: Michael M. Frondorf, Lakeside Park, KY (US); Bradley T. Wilson, Batesville, IN (US); Jacqueline A. Robertson, Batesville, IN (US); Michael P. Boland, West Chester, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 11/563,269

(22) Filed: Nov. 27, 2006

(65) Prior Publication Data

US 2007/0143920 A1 Jun. 28, 2007

Related U.S. Application Data

(60) Provisional application No. 60/740,936, filed on Nov. 30, 2005.

(51) Int. Cl.
*A61G 7/002* (2006.01)

(52) U.S. Cl. ..... 5/613; 5/617; 5/600

(58) Field of Classification Search ..... 5/600, 5/722, 622, 613

See application file for complete search history.

(56) References Cited

U.S. PATENT DOCUMENTS

| | | | | |
|---|---|---|---|---|
| 2,403,420 | A | 7/1946 | Willingham | |
| 4,578,980 | A | 4/1986 | Beckman | |
| 4,769,584 | A | 9/1988 | Irigoyen et al. | |
| 5,082,357 | A | 1/1992 | Hass et al. | |
| 5,181,288 | A * | 1/1993 | Heaton et al. | 5/607 |
| 5,205,004 | A * | 4/1993 | Hayes et al. | 5/611 |
| 5,611,096 | A | 3/1997 | Bartlett et al. | |
| 5,673,443 | A * | 10/1997 | Marmor | 5/88.1 |
| 5,822,813 | A | 10/1998 | Powell | |
| 6,014,784 | A * | 1/2000 | Taylor et al. | 5/713 |
| 6,353,949 | B1 * | 3/2002 | Falbo | 5/610 |
| 6,353,950 | B1 | 3/2002 | Bartlett et al. | |
| 6,356,203 | B1 | 3/2002 | Halleck et al. | |
| 6,397,716 | B1 | 6/2002 | Garuglieri | |
| 6,505,365 | B1 | 1/2003 | Hanson et al. | |
| 6,566,833 | B2 * | 5/2003 | Bartlett | 318/564 |
| 6,904,631 | B2 | 6/2005 | Vrzalik et al. | |
| 7,089,612 | B2 | 8/2006 | Rocher et al. | |
| 7,117,607 | B2 | 10/2006 | Horgan | |

(Continued)

FOREIGN PATENT DOCUMENTS

| | | |
|---|---|---|
| FR | 2819173 | 7/2002 |

OTHER PUBLICATIONS

English Translation of the Abstract for FR2819173 (1 page).

(Continued)

*Primary Examiner*—Patricia Engle
*Assistant Examiner*—William Kelleher
(74) *Attorney, Agent, or Firm*—Barnes & Thornburg LLP

(57) ABSTRACT

A patient support apparatus includes a frame, a head section coupled to the frame and movable relative to the frame between first and second angular positions, and a sensor operable to determine an angular position of the head section. The apparatus also has an alarm that is activated if the angular position of the head section is not sufficiently large enough.

36 Claims, 11 Drawing Sheets

U.S. PATENT DOCUMENTS

| | | | | |
|---|---|---|---|---|
| 2002/0170116 | A1* | 11/2002 | Borders et al. | 5/600 |
| 2004/0207241 | A1 | 10/2004 | Sedlack | |
| 2005/0172405 | A1 | 8/2005 | Menkedick et al. | |
| 2006/0080777 | A1 | 4/2006 | Rocher et al. | |
| 2006/0101581 | A1* | 5/2006 | Blanchard et al. | 5/713 |
| 2007/0044237 | A1 | 3/2007 | Williams | |

OTHER PUBLICATIONS

Torres A., et al., Pulmonary Aspiration of Gastric Contents in Patients Receiving Mechanical Ventilation: The Effect of Body Position; Universitat de Barcelona, Spain, Ann Intern Med. Apr. 1, 1992; 116(7): 540-3.

Fernandez-Crehuet R., et al., Nosocomial Infection in an Intensive-Care Unit: Identification of Risk Factors; Department of Preventive Medicine, Reina Sofia University Hospital, Cordoba, Spain: Infect Control Hosp Epidemiol. Dec. 1997; 18(12): 825-30.

Orozco-Levi M., et al., Semirecumbent Position Protects From Pulmonary Apiration but not Completely From Astroesophageal Reflux in Mechanically Ventilated Patients; Department de Medicina, Universitat de Barcelona, Spain; Am J Respir Crit Care Med. Oct. 1995; 152(4 Pt 1): 1387-90.

Kollef, M.H., Ventilator-Associated Pneumonia. A Multivariate Analysis, Department of Internal Medicine, Washington University School of Medicine, St. Louis, MO 63110; JAMA, Oct. 1993; 270: 1965-1970.

Helman, Donald L., et al., Effect of Standardized Orders and Provider Education on Head-of-Bed Positioning in Mechanically Ventilated Patients: Crit Care Med 2003, vol. 31, No. 9, pp. 2285-2290.

Drakulovic, Mitra B., et al., Supine Body Position as a Risk Factor for Nosocomial Pneumonia in Mechanically Ventilated Patients: A Randomised Trial, The Lancet; Nov. 27, 1999; 354,9193; Research Library, pp. 1851-1858.

Webster, Nigel R., Importance of Position in Which Patients are Nursed in Intensive-Care Units; The Lancet; Nov. 27, 1999; 354; 9193; Research Library, p. 1835.

Grap, Mary Jo et al., Predictors of Backrest Elevation in Critical Care, Intensive and Critical Care Nursing (2003) 19, pp. 68-74.

CDC, Morbidity and Mortality Weekly Report, Guidelines for Preventing Health-Care- Associated Pneumonia 2003—Recommendations of CDC and the Healthcare Infection Control Practices Advisory Committee, Mar. 25, 2004 / vol. 53 / No. RR-3.

Baumann, Dr. Michael. Device May Decrease Ventilator Associated Pneumonia, Critical Care Medicine, Chest Physician, Feb. 2006, p. 8.

* cited by examiner

HEAD ANGLE > 30 SUMMARY page 1 280

| | TIME | SUMMARY |
|---|---|---|
| 296 | 01/28/05 12:00 AM | HRS:Min Head Angle > 30,since12AM- 13:19 |
| 298 | 01/27/05 12:00 AM | HRS:Min Head Angle > 30,since12AM- 12:45 |
| 300 | 01/26/05 12:00 AM | HRS:Min Head Angle > 30,since12AM- 21:34 |
| 302 | 01/25/05 12:00 AM | HRS:Min Head Angle > 30,since12AM- 04:56 |

Press ENTER to return To the Main Menu

Next page Return to Statistics

Fig. 14

HEAD ANGLE > 30 SUMMARY page 2 282

| | TIME | SUMMARY |
|---|---|---|
| 304 | 01/24/05 12:00 AM | HRS:Min Head Angle > 30,since12AM- 09:47 |
| 306 | 01/23/05 12:00 AM | HRS:Min Head Angle > 30,since12AM- 22:21 |
| 308 | 01/22/05 12:00 AM | HRS:Min Head Angle > 30,since12AM- 13:23 |
| 310 | 01/21/05 12:00 AM | HRS:Min Head Angle > 30,since12AM- 11:06 |

Press ENTER to view the Previous page of Summary

Previous page Return to Statistics

Fig. 15

HOSPITAL BED HAVING HEAD ANGLE ALARM

CROSS REFERENCE TO RELATED APPLICATION

This application claims the benefit of U.S. Provisional Patent Application Ser. No. 60/740,936, filed on Nov. 30, 2005, and entitled "Hospital Bed Having Head Angle Alarm," which is hereby incorporated by reference herein.

BACKGROUND OF THE INVENTION

The present disclosure relates to a patient support apparatus having at least one articulable deck section to support a patient in a variety of positions. More particularly, the present disclosure relates to a patient support apparatus, such as a hospital bed, having an alarm system.

The Joint Committee on Accreditation of Healthcare Organizations (JCAHO) recommends that, under some circumstances, a patient be supported on a hospital bed in a semi-recumbent position, instead of a supine position, to reduce the risk of Ventilator-Associated Pneumonia (VAP) occurrence. JCAHO recommends head-of-bed angle (HOBA) for mechanically ventilated patients of 45° in order to prevent pneumonia. For patients at high risk of skin breakdown, head-of-bed angle of 30° is recommended in order to prevent pneumonia and the development of pressure ulcers.

SUMMARY OF THE INVENTION

The present invention comprises an apparatus and/or a method having one or more of the features recited in the claims or one or more of the following features, which alone or in any combination may comprise patentable subject matter:

A patient support apparatus, such as a hospital bed, may include a frame, a deck section coupled to the frame and movable relative to the frame between first and second angular positions, and a head-of-bed angle alarm system. The head-of-bed angle alarm system may include a sensor operable to determine an angular position of the deck section, an alarm, and a controller coupled to the sensor and to the alarm. The controller may be configured to activate the alarm when the alarm is armed and the angular position of the deck section is greater than, greater than or equal to, less than, or less than or equal to a threshold angle. The controller may be configured to activate the alarm when the alarm is armed and the angular position of the deck section is outside first and second threshold angles.

The deck section may comprise a head section of a patient support deck of a hospital bed. The alarm system may have an on/off button to selectively enable the alarm. In some embodiments, the alarm on/off button may be shown on an electronic display screen, such as a display screen of a graphical caregiver interface (GCI) of the bed. An example of such a bed having a GCI is the TotalCare® bed marketed by Hill-Rom Company, Inc. of Batesville, Ind. In the TotalCare® bed, the GCI is located on an outboard side of an intermediate siderail of the bed for use by a caregiver. In some other embodiments, the alarm on/off button may be located on a frame member or a siderail of the bed. In some embodiments, the alarm system may be armed and disarmed from a nurse control station that is remote from the bed. As used herein, the terms "armed" and "enabled" (and variations thereof) are intended to be synonymous and each term is intended to have the broad meanings of both. Similarly, as used herein the terms "disarmed" and "disabled" (and variations thereof) are intended to be synonymous and each term is intended to have the broad meanings of both.

The threshold angle may include at least one fixed value (e.g., 30°). The fixed threshold angle(s) may be stored in a memory associated with the controller. In some embodiments, the threshold angle may not be fixed but rather, may be selectable at any suitable angle. In some embodiments, the threshold angle may be selectable by a caregiver using the GCI of the bed. Alternatively or additionally, a caregiver may select the threshold angle by using a threshold angle selector located on a frame member or a siderail of the bed. Alternatively or additionally, the threshold angle selector may be located on a wireless hand unit or located on a hand unit coupled to the controller by a cable or located on a wall of a hospital room where the apparatus is located. Alternatively or additionally, the threshold angle may be selectable at a remote nurse control station.

The alarm may normally be disabled or disarmed. To set the alarm, the caregiver may raise the head section to a position above the threshold angle and then enable the alarm so that when the head section drops below the threshold angle the alarm is activated. The alarm may be aural (e.g., audible tone) or visual (e.g., a flashing light) or both aural and visual. For example, in some embodiments, the audible alarm may be located on a frame member of the bed and the visual alarm may be in the form of an indication on the GCI of the bed. Alternatively or additionally, the visual alarm may be in the form of a flashing light located near a doorway of a hospital room where the bed is located. The flashing light may be part of a so-called dome light of a nurse call system, which dome lights are sometimes located outside one or more of the patient rooms of a hospital.

In some embodiments, the sensor may comprise a rotary potentiometer that senses relative rotation between the deck section and some other structure, such as the frame of the bed. Alternatively or additionally, the sensor may comprise an inclinometer or accelerometer coupled to the deck section for movement therewith. For example, the inclinometer may be secured to an underside of the deck section. Alternatively or additionally, the sensor may comprise a limit switch coupled to the controller, and the limit switch may activate the alarm when the deck section is above, above or at, below, or below or at a threshold angle. Such a limit switch may comprise a ball switch. The angle sensor may be coupled to some other structure, such as a mattress or a siderail, that moves with the deck section.

The patient support apparatus may comprise an actuator coupled to the deck section and operable to move the deck section relative to the frame between the first and second angular positions. In some embodiments, the actuator may comprise a hydraulic actuator coupled to a hydraulic power unit of the bed. In some embodiments, the actuator may comprise a motor having a drive shaft, and the sensor may comprise a shaft encoder coupled to the drive shaft to determine the amount of rotation of the drive shaft as the deck section is moved between the first and second angular positions. The actuator may comprise a linear actuator with a motor, gear reducer, and a threaded shaft that rotates to extend and retract an output shaft of the linear actuator. The angle sensor may comprise a potentiometer coupled to the linear actuator to rotate with the rotatable components (e.g., motor shaft, a shaft of the gear reducer, the threaded shaft, etc.) of the linear actuator.

The controller may be configured to correlate data received from the angle sensor, before or after analog to digital conversion, to an angle of a deck section relative to horizontal and/or relative to some other structure such as a frame of the bed. The controller may be configured to compare data corresponding to the deck section angular position detected by the sensor to data corresponding to the user-selected threshold angle and to activate the alarm when the data corresponding to the deck section angular position is greater than (sometimes referred to herein as "above"), greater than or equal to (sometimes referred to herein as "above or at"), less than (sometimes referred to herein as "below"), or less than or equal to (sometimes referred to herein as "below or at") the threshold angle. The data corresponding to the deck section angular position and the data corresponding to the threshold angle may be respective voltages which, in some cases, are converted to digital data.

A method is disclosed for activating an alarm when an angular position of a deck section coupled to a frame of a patient support apparatus is greater than, greater than or equal to, less than, or less than or equal to a threshold angle as the deck section moves between first and second angular positions relative to the frame and/or relative to horizontal. The method comprises the steps of sensing the angular position of the deck section, comparing the deck section angular position to the threshold angle, and activating the alarm when the deck section angular position is greater than, greater than or equal to, less than, or less than or equal to a threshold angle. The method may further comprise raising the deck section above the threshold angle and enabling the alarm so that when the deck section drops below the threshold angle the alarm is activated.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the following figures, in which:

FIGS. 14 and 15 are screen shots of pop-up statistics boxes that appear on the pulmonary statistics screen in response to appropriate user inputs to select the head angle summary option of the pulmonary statistics screen.

DETAILED DESCRIPTION OF THE DRAWINGS

Figure 1:
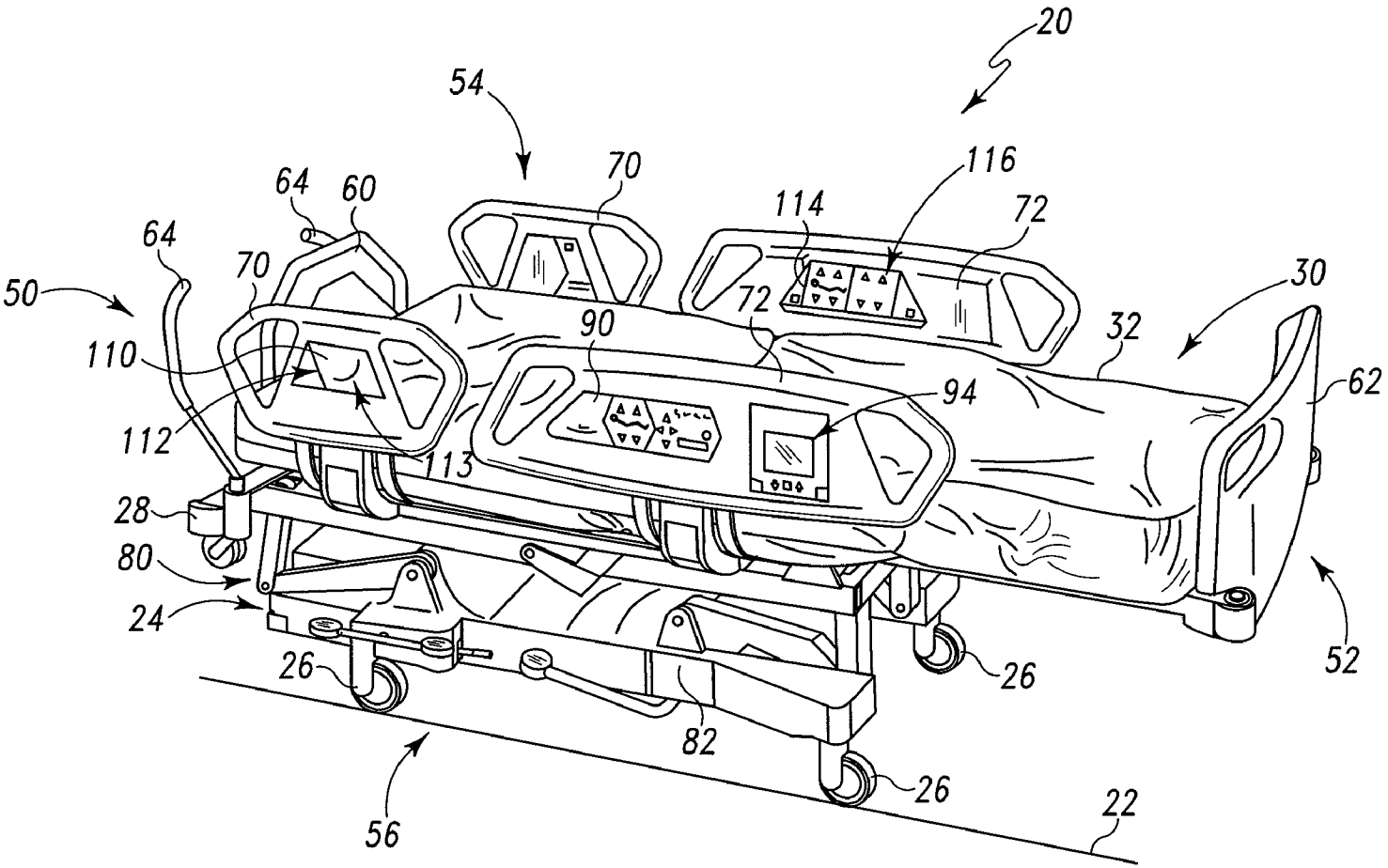
FIG. 1 is a perspective view of an illustrative hospital bed showing a base frame supported on casters, a shroud covering the various mechanisms carried by the base frame, an intermediate frame supported above the base frame, an articulable deck carried by the intermediate frame, a mattress supported on the deck, a pair of head-end siderails coupled to left and right sides of a head section of the deck, a pair of intermediate siderails coupled to left and right sides of the intermediate frame, and a pair of push handles coupled to the intermediate frame near a head end thereof, the bed having a head-of-bed angle alarm system that is activated when a head section of the deck is above, above or at, below, or below or at a threshold angle.
Figure 2:
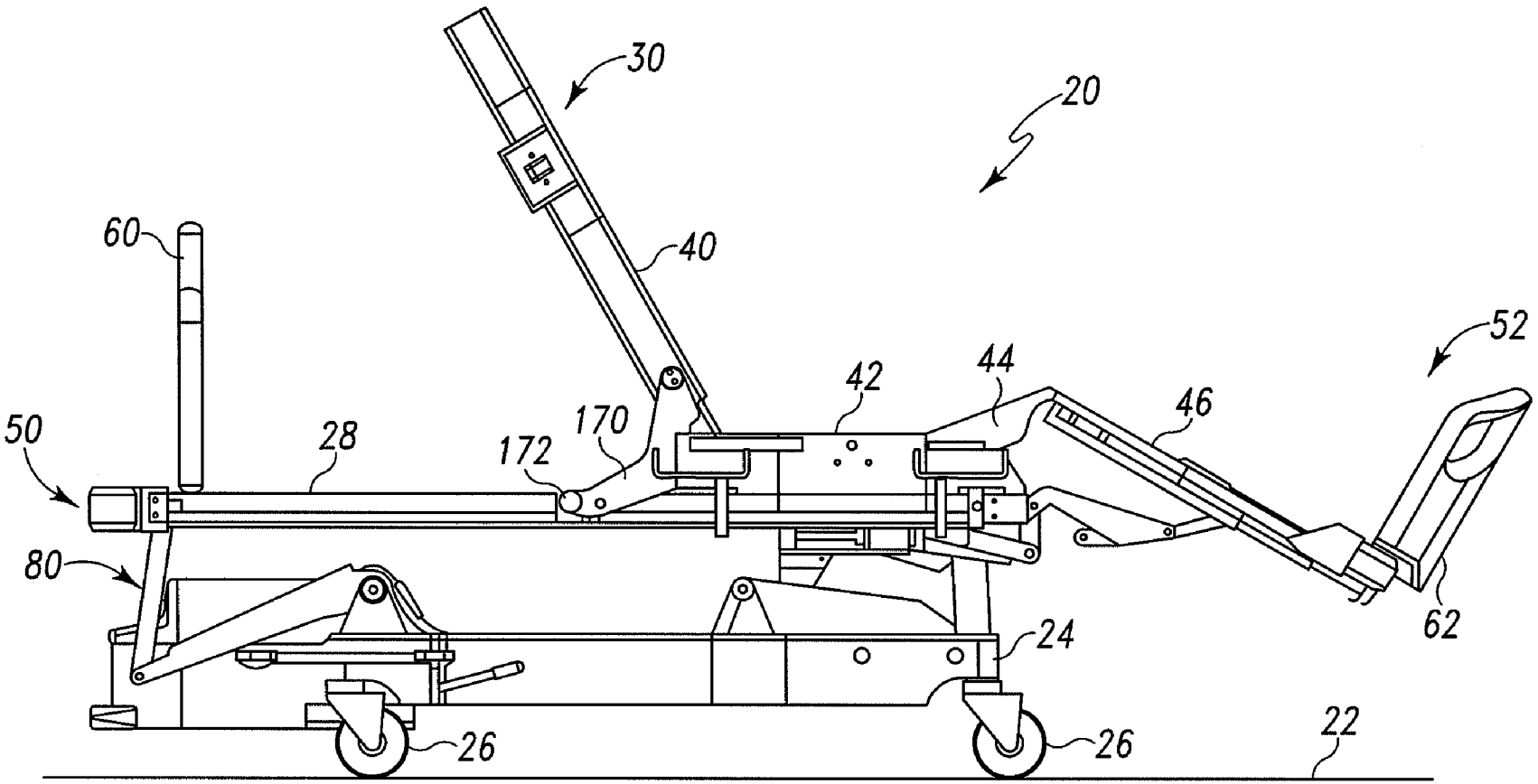
FIG. 2 is a side elevation view of the bed of FIG. 1 with the siderails, mattress, push handles and shroud removed for clarity, and showing the articulable deck having longitudinally-spaced head, seat, thigh and leg sections with the head and thigh sections pivoted upwardly relative to the seat section and the leg section pivoted downwardly relative to the thigh section.

FIGS. 1 and 2 show a patient support apparatus, such as a hospital bed 20, supported on a floor 22 of a hospital room. The bed 20 includes a head-of-bed angle alarm system 150 as shown diagrammatically in FIG. 5. Illustratively, the bed 20 includes a base frame 24 supported on casters 26, an intermediate frame 28 supported above the base frame 24, an articulable deck 30 supported above the intermediate frame 28. In some embodiments, the intermediate frame 28 includes multiple frames, such as an upper frame and a weigh frame. A mattress 32 is supported on the deck 30. The deck 30 includes longitudinally spaced head, seat, thigh and leg sections 40, 42, 44, and 46, respectively.

The seat section 42 is fixed to the intermediate frame 28, but this need not be the case. The head section 40 is coupled to the intermediate frame 28 near a head end 50 of the seat section 42 for pivoting movement between a first position shown in FIG. 1 where the head section 40 is generally coplanar with the seat section 42 and a second position shown in FIG. 2 where the head section 40 is raised relative to the seat section 42. The thigh section 44 is coupled to a foot end 52 of the seat section 42 for movement between a first position shown in FIG. 1 where the thigh section 44 is generally coplanar with the seat section 42 and a second position shown in FIG. 2 where the thigh section 44 is raised relative to the seat section 42. The leg section 46 is coupled to the foot end 52 of the thigh section 44 for movement between a first position shown in FIG. 1 where the leg section 46 is generally coplanar with the thigh section 44 and a second position shown in FIG. 2 where the leg section 46 is lowered relative to the thigh section 44.

In the illustrative embodiment shown in FIGS. 1 and 2, the head section 40 is configured to pivot relative to the intermediate frame 28 about an effective pivot axis positioned to lie above a sleeping surface of the mattress 32. Preferably, the effective pivot axis of the head section 40 is located generally adjacent to a pivot axis defined by the hip of a person lying on the mattress sleeping surface in order to minimize the shear between the mattress sleeping surface and the back of a person lying in the bed 20 as the head section 40 moves between the lowered and raised positions. To achieve this reduced-shear pivot, the head section 40 is mounted to the intermediate frame 28 for both translational movement and pivoting movement relative to the intermediate frame 28. The pivoting and translational movements combine to produce a motion in which the head portion 40 pivots relative to the intermediate frame 28 about the effective pivot axis. U.S. Pat. No. 5,682,631 illustrates a hospital bed having a head section mounted to a bed frame to pivot about a reduced-shear pivot.

Figure 5:
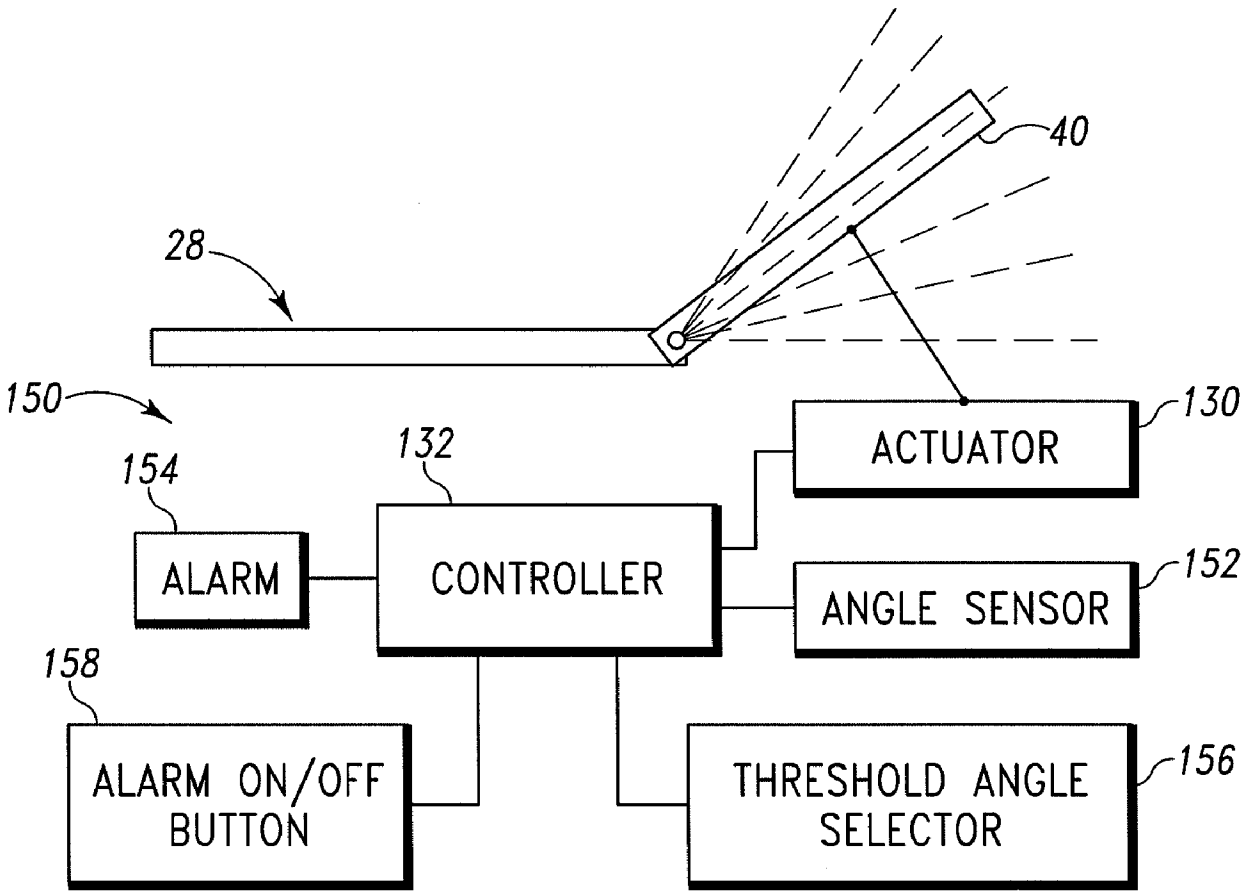
FIG. 5 is a block diagram showing components of a first embodiment of the head-of-bed angle alarm system including a head-of-bed angle sensor operable to determine an angular position of the head section, a head-of-bed angle alarm, an alarm on/off button, a threshold angle selector, and a controller coupled to the sensor, the head-of-bed angle alarm, the alarm on/off button, and the threshold angle selector.

The bed 20 includes several hydraulic actuators, including a head section actuator 130 shown diagrammatically in FIG. 5. The head section actuator 130 is operable to move the head section 40 between first and second angular positions shown respectively in FIGS. 1 and 2. The head section actuator 130 includes a piston rod (not shown) coupled to the head section 40 and a hydraulic cylinder (not shown) coupled to the intermediate frame 28. The hydraulic cylinder is coupled to a hydraulic power unit (not shown) mounted on the base frame 24. In some embodiments, the head section actuator is a linear motor (not shown) having a drive shaft. An illustrative hospital bed with a hydraulic actuator for moving a head section of the bed is disclosed in U.S. Pat. No. 5,715,548, which is hereby incorporated by reference herein.

A headboard 60 is removably coupled to the intermediate frame 28 near the head end 50. A footboard 62 is removably coupled to the leg section 46 near the foot end 52. A pair of push handles 64 are removably coupled to the intermediate frame 28 near the head end 50. A pair of head-end siderails 70 are coupled to respective left and right sides 54, 56 of the head section 40 of the deck 30 for movement therewith. A pair of intermediate siderails 72 are coupled to the respective left and right sides 54, 56 of the intermediate frame 28 for movement therewith.

An elevation adjustment mechanism 80 connects the intermediate frame 28 to the base frame 24. The elevation adjustment mechanism 42 is operable to raise, lower, and tilt the intermediate frame 28 relative to the base frame 24. For example, the elevation adjustment mechanism 80 is operable to tilt the intermediate frame 28 between a Trendelenburg position in which the head end 50 of the intermediate frame 28 is below the foot end 52 of the intermediate frame 28 and a reverse Trendelenburg positions in which the head end 50 of the intermediate frame 28 is above the foot end 52 of the intermediate frame 28. The base frame 24 is covered by a protective shroud 82 to shield from view various mechanisms, such as the hydraulic power unit coupled to various hydraulic actuators, mounted thereon and to prevent foreign objects from being inadvertently inserted therein. An illustrative elevation adjustment mechanism for raising, lowering, and tilting an intermediate frame is disclosed in above-mentioned U.S. Pat. No. 5,715,548, which is hereby incorporated by reference herein.

Figure 3:
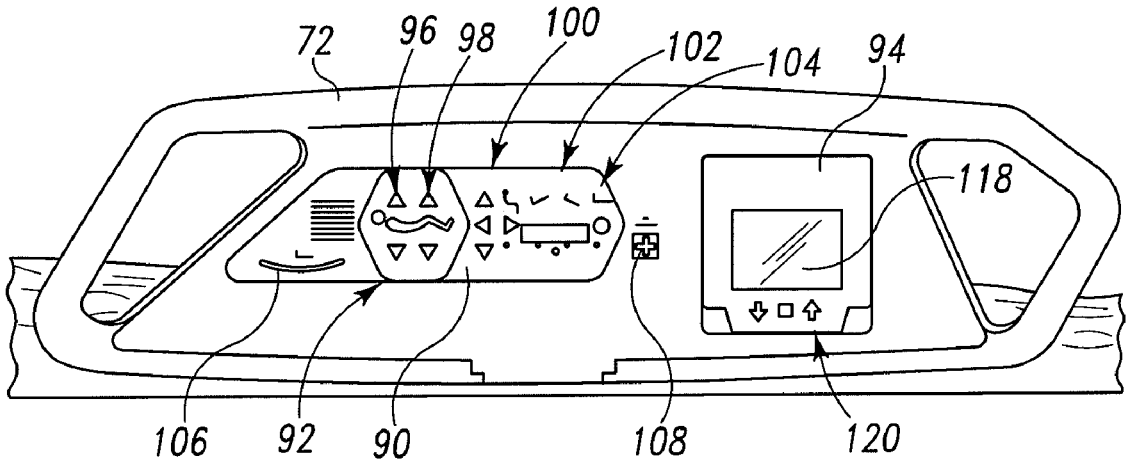
FIG. 3 is a front elevation view of a siderail showing a caregiver control panel having a plurality of controls including, for example, a graphical caregiver interface ("GCI"), head up/down controls, knee up/down controls, chair positioning controls, Trendelenburg and reverse Trendelenburg controls, bed up/down controls, a Trendelenburg angle indicator, and a nurse call control.

As shown in FIG. 3, the right intermediate siderail 72 has a caregiver control panel 90 on an outboard side thereof. The caregiver control panel 90 has a plurality of caregiver controls 92 including, for example, a graphical caregiver interface ("GCI") 94, head up/down controls 96, knee up/down controls 98, chair positioning controls 100, Trendelenburg and reverse Trendelenburg controls 102, bed up/down controls 104, a Trendelenburg angle indicator 106, and nurse call control 108. Likewise, in the illustrated embodiment, the right head-end siderail 70 has a caregiver control panel 110 with a plurality of caregiver controls 112 on an outboard side thereof, including a head-of-bed angle indicator 113. The head-of-bed angle indicator 113 mechanically indicates the angle of the head section 40 from −15° to +80° with respect to the floor 22. The indicia where the indicator ball rests is the correct angle. The left intermediate siderail 72 has a patient control panel 114 with a plurality of patient controls 116 on an inboard side thereof. The terms "caregiver" and "user" are used interchangeably, and each term broadly includes the meaning of both.

Figure 4:
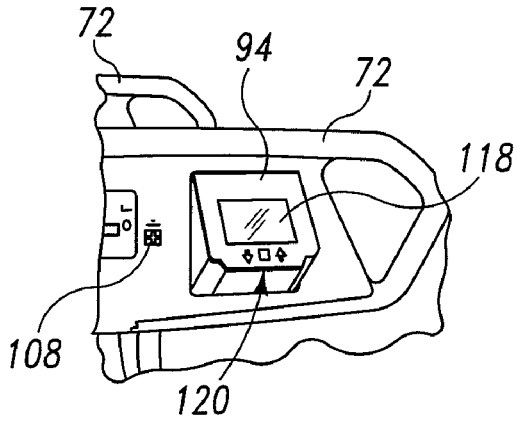
FIG. 4 is a front elevation view of a portion of the siderail of FIG. 3 showing a display screen of the GCI tilted out of a siderail cavity for more ergonomic use by a caregiver.

As shown in FIG. 4, the GCI 94 has a swing-out display screen 118 that is movable between a storage position shown in FIG. 3 and a use position shown in FIG. 4 (although it should be noted that the GCI 94 may be used when in the storage position, if desired). A caregiver interacts with the GCI 94 by using three controls 120 located at the bottom of the display screen 118—namely, a scroll up arrow, a scroll down arrow and an enter button. The controls 92 located on the caregiver control panel 90 allow a caregiver to control the operation of the bed 20, such as, for example, to raise or lower the deck 30, tilt the intermediate frame 28, and move the deck 30 to a chair configuration. The controls 92 are coupled to a controller 132 of the bed 20 as shown diagrammatically in FIG. 5.

In the illustrative embodiment, the controller 132 includes several microprocessors (not shown) located on various parts of the bed 20. For example, a microprocessor is located on the intermediate siderail 72 having the caregiver control panel 90 on its outboard side. In addition, a main circuit board (not shown) having several microprocessors is located on the base frame 24 of the bed 20. The microprocessors are configured to execute software stored in associated memories to perform steps that are included in the software. The controller 132 may be coupled to a computer network of the hospital. An illustrative computer network is disclosed in U.S. Patent Application Publication No. 2006/0049936 A1, which is hereby incorporated by reference herein. An illustrative bed of this type is a TotalCare® bed marketed by Hill-Rom Company, Inc., Batesville, Ind. 47006. Of course, controller 132 may include only a single microprocessor, microcontroller or other logic based integrated circuit component, or controller 132 may include a plurality of discrete logic based circuit elements, in lieu of having plural microprocessors.

As shown diagrammatically in FIG. 5, the head-of-bed angle alarm system 150 includes a head-of-bed angle sensor 152 operable to determine an angular position of the head section 40, a head-of-bed angle alarm 154, a threshold angle selector 156 and a head-of-bed angle alarm on/off button 158. In embodiments where the head-of-bed angle is fixed (e.g., 30°), the threshold angle selector 156 may be omitted. The controller 132 is coupled to the angle sensor 152, the alarm 154, the threshold angle selector 156 and the alarm on/off button 158. The controller 132 activates the alarm 154 when the angular position of the head section 40 or the head-of-bed angle is greater than, greater than or equal to, less than, or less than or equal to a threshold angle, as the case may be, depending upon the software programming in a particular embodiment. As indicated above, the Joint Committee on Accreditation of Healthcare Organizations (JCAHO) recommends head-of-bed angle (HOBA) for mechanically ventilated patients of 45° in order to prevent pneumonia. For patients at high risk of skin breakdown, head-of-bed elevation of 30° is recommended to prevent pneumonia and the development of pressure ulcers.

The head section 40 is diagrammatically shown in FIG. 5 to pivot relative to the intermediate frame 28 about a simple pivot axis. However, in the illustrated embodiment, the head section 40 is mounted to the intermediate frame 28 to pivot about a reduced-shear pivot as discussed above. U.S. Pat. No. 5,682,631 illustrates a hospital bed having head section mounted to a bed frame to pivot about a reduced-shear pivot. Accordingly, all types of connections for coupling one deck section of a bed to another are within the scope of this disclosure including simple pivots, compound pivots, reduced-shear pivots, and pivots having arcuate tracks or slots, just to name a few.

It is contemplated by this disclosure that the head-of-bed angle of the head section may be measured or calculated with respect to any other portion of the bed, such as for example the intermediate frame, weigh frame, seat section, or base frame, or with respect to horizontal or vertical. Thus, it is contemplated that one or more types of angle sensors, such as a potentiometer, limit switch, ball switch, accelerometer, inclinometer, linear variable displacement transducer (LVDT), or hall effect sensor, just to name a few, may be provided on a hospital bed to provide signals that are used to measure or calculate angles of bed components to arrive at the head-of-bed angle. In the illustrative embodiment, the head-of-bed angle is an angle through which the head section 40 is raised with respect to the base frame 24, not with respect to the intermediate frame 28. Thus, in the illustrative embodiment, when the head-of-bed angle is 30°, the head section 40 is raised to a 30° angle relative to the base frame 24. In other embodiments, the angle of the head section 40 relative to the intermediate frame 28 is considered to be the head-of-bed angle. In some other embodiments, the head-of-bed angle may be the angle of the head section 40 relative to a horizontal direction or to a vertical direction (e.g. the direction of gravity force) to account for the slope of the surface on which the bed 20 is supported. The terms "head-of-bed angle" and "head-of-bed elevation" are used interchangeably in this disclosure, and each broadly refers to the angle of the head section of the bed relative to something else.

If the intermediate frame 24 is tilted clockwise by 15°, as viewed in FIG. 2, so that the head end 50 of the intermediate frame 28 is above the foot end 52 of the intermediate frame 28, and the head section 40 is raised (i.e., pivoted clockwise) relative to the intermediate frame 28 by 30°, the head-of-bed angle is considered to be 45° in the illustrative embodiment. On the other hand, if the intermediate frame 24 is tilted counterclockwise by 15°, as viewed in FIG. 2, so that the head end 50 of the intermediate frame 28 is below the foot end 52 of the intermediate frame 28, and the head section 40 is raised (i.e., pivoted clockwise) relative to the intermediate frame 28 by 30°, the head-of-bed angle is considered to be 15° in the illustrative embodiment.

The desired head-of-bed angle is sometimes referred to herein as a threshold angle. In the illustrated embodiment, the threshold angle is fixed (e.g. 30° above horizontal). The fixed threshold angle is stored in a memory, such as a flash memory, associated with the controller 132. In some embodiments, however, the threshold angle is selectable. For example, in one possible embodiment the threshold angle may be selectable from about 30° to about 45°. In such embodiments, the caregiver uses the threshold angle selector 156 to select the threshold angle. In some embodiments, the threshold angle selector 156 is the GCI 94 of the caregiver control panel 90. In some other embodiments, the threshold angle selector 156 is some other user input such, as a knob (not shown) located on a frame member, such as the intermediate frame 28, or on a siderail, such as the intermediate siderail 72, of the bed 20. In still other embodiments, the threshold angle selector 156 may be provided on a wired or wireless hand-held unit (sometimes referred to in the art as a "pendent"). Controller 132, alarm 154, and/or alarm on/off button 158 may also be provided on such a hand-held pendent, if desired.

Figure 8:
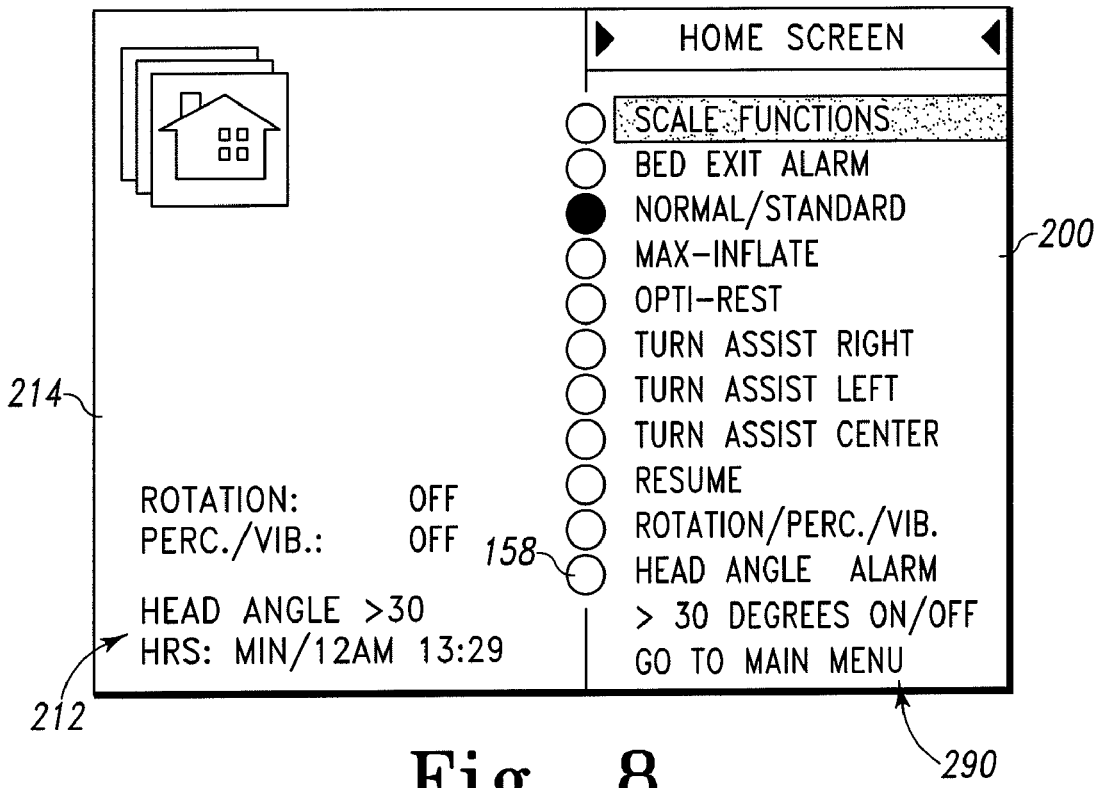
FIG. 8 is a screen shot of a home screen that appears on the GCI, the home screen having a menu including a radio button which indicates whether the head-of-bed angle alarm system is armed or disarmed.

In the illustrated embodiment, the alarm on/off button 158 is located on a home screen 200 (FIG. 8) of the GCI 94 of the caregiver control panel 90 of the bed 20. The alarm on/off button 158 located on the home screen 200 is a so called radio button that indicates whether system 150 is on (i.e., "armed") or off (i.e., "disarmed). The up and down scroll arrows of controls 120 of GCI 94 are used to highlight or select the various text options and the enter button of controls 120 is pressed to change the status of the system associated with the highlighted text. Each press of the enter button when the text is highlighted adjacent button 158 changes the state of the alarm system 150 between an "armed" state and a "disarmed" state. In the illustrated embodiment, the alarm system 150 is normally disarmed or off. The alarm on/off button 158 on the home screen 200 is blank when the alarm system 150 is off as shown in FIG. 8. When the alarm system 150 is armed or on, the alarm on/off button 158 on the home screen 200 is filled in. In the screen shown in FIG. 8, the radio button adjacent the text "normal/standard" is filled in. Thus, in the illustrative example, button 158 serves as a visual indicator to show whether system 150 is armed or disarmed. In other embodiments, an alarm on/off button 158 is located on a frame member, such as the intermediate frame 28, or a siderail, such as the intermediate siderail 72, of the bed 20 or on a hand-held unit as described above. In some embodiments, the alarm on/off button 158 may be part of a touchscreen that the user touches directly (instead of via separate controls 120) to arm and disarm system 150. Alternatively or additionally, system 150 maybe armed and disarmed remotely from a nurse control station and button 158 is changed accordingly when the system is armed or disarmed remotely.

In the illustrative embodiment, the angle sensor 152 comprises a rotary potentiometer (not shown) coupled to the controller 132 through appropriate signal conditioning circuitry such as an amplifier and an analog-to-digital (A/D) converter. The potentiometer has a rotary member (not shown) coupled to a pivot shaft 172, shown in FIG. 2, for rotation therewith and a stationary member (not shown) secured to the intermediate frame 28. Shaft 172 pivots along with a link 170 during pivoting movement of head section 40. The potentiometer and associated circuitry provides an output signal that controller 132 correlates to the angle A° through which the head section 40 is inclined relative to the intermediate frame 28. The controller 132 also receives data from one or more other angle sensors relating to the angle B° through which the intermediate frame 28 is pivoted relative to the base frame 24. The one or more other angle sensors may comprise an accelerometer or inclinometer coupled to intermediate frame 28 in some embodiments and may comprise potentiometers coupled to respective members of the elevation adjustment mechanism 80 and base frame 29 in other embodiments. Any of the various types of angle sensors disclosed herein may be used to measure the tilt of intermediate frame 28 relative to base frame 24 or relative to horizontal or vertical. The controller 132 determines the head-of-bed angle by either adding (when the head end 50 of the intermediate frame 28 is above the foot end 52 of the intermediate frame 28) or subtracting (when the head end 50 of the intermediate frame 28 is below the foot end 52 of the intermediate frame 28) the two angles A° and B°.

In some embodiments, the angle sensor 152 comprises an inclinometer coupled to the controller 132 and secured to an underside of the head section 40. In some other embodiments, the angle sensor 152 comprises a limit switch (not shown) coupled to the controller 132. The limit switch activates the alarm 154 when the head section 40 is above, above or at, below, or below or at the threshold angle depending on how the alarm system 150 is configured. Such a limit switch may be, for example, a ball switch or other type of two-position switch.

In the illustrative embodiment, actuator 130 is a hydraulic actuator. In some embodiments, the head section actuator 130 for moving the head section 40 relative to the intermediate frame 28 between the first and second angular positions is a linear actuator or other type of motor (not shown) having a drive shaft. In such embodiments, the angle sensor 152 may comprises a shaft encoder (not shown) coupled to the drive shaft and coupled to the controller 132. The shaft encoder determines the amount of rotation of the drive shaft as the head section 40 is raised and lowered relative to the intermediate frame 28. The controller 132 converts the data corresponding to the rotation of the drive shaft to the angle through which the head section 40 is raised relative to the intermediate frame 28. In still other embodiments a linear actuator may include a potentiometer that measures the amount of rotation of rotatable components of the actuator which relates to the amount of extension and retraction of any output shaft of the linear actuator which, in turn, relates to the angle at which head section 40 is inclined.

The controller 132 is configured to compare data corresponding to the head section angular position, as determined by data from the angle sensor 152 and the other angle sensors, to data corresponding to the threshold angle and activates the alarm 154 when the data corresponding to the head section angular position is less than or equal to the data corresponding to the threshold angle. In other embodiments, and at the option of the system designer and software programmer, the logic condition to be satisfied for activating the alarm may be a greater than, a greater than or equal to, or a less than condition, in lieu of the less than or equal to logic condition of the illustrative embodiment. In some embodiments, the data corresponding to the head section angular position and the data corresponding to the threshold angle may be respective analog voltages which are fed to a comparator which determines whether the threshold condition is met resulting in activation of the alarm. In such embodiments, the comparator is considered to be a "controller" because the output of the comparator controls whether or not alarm 154 is activated.

Figure 11:
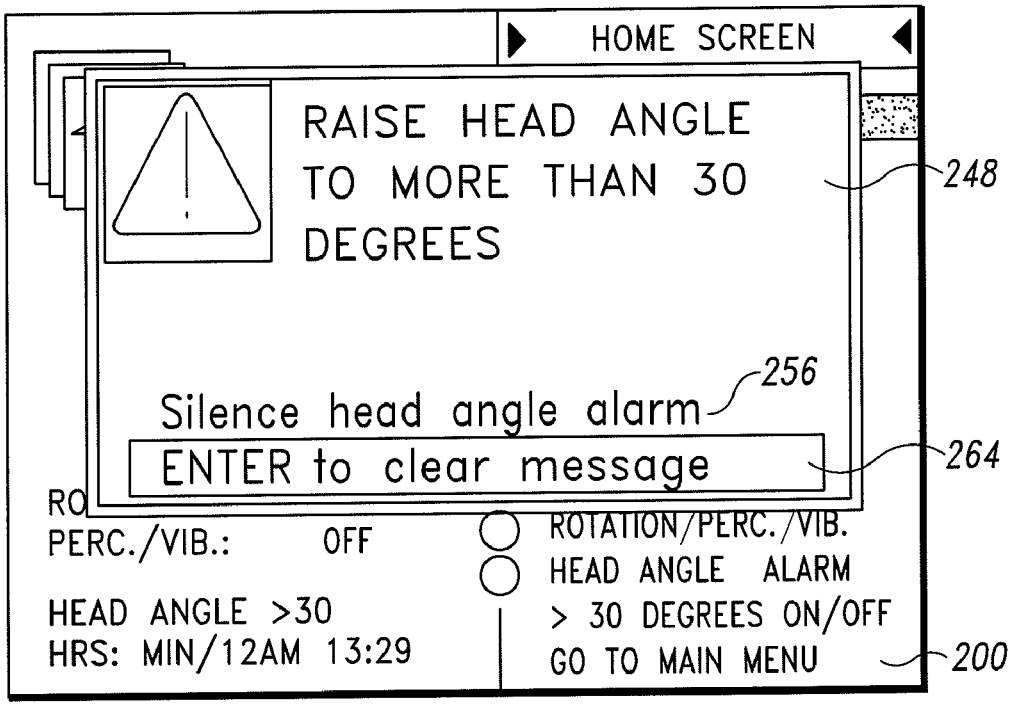
FIG. 11 is a screen shot of a pop-up box that serves as a visual alarm which appears on the display screen of the GCI if the head-of-bed angle alarm is armed and the head section is lowered below the threshold angle.

In the illustrated embodiment, the alarm 154 is both aural and visual. The aural alarm is located on the main circuit board (not shown) mounted on the intermediate frame 28 of the bed 20. The aural alarm may be, for example, a speaker or piezoelectric buzzer. The visual alarm is in the form of a message box 236 (FIG. 11) on the GCI 94 of the caregiver control panel 90 of the bed 20. The controller 132 may be configured to cause the message box 236 to flash to make it more noticeable to the caregiver. Alternatively or additionally, the visual alarm is in the form of a flashing light, such as a dome light of a nurse call system, located near a doorway of a hospital room where the bed 20 is located. Alternatively or additionally, the visual alarm may be a message or other viewable indicia which appears on a computer screen at a remote nurse station and/or the aural alarm may be produced at the remote nurse station by a sound producing device such as a speaker in a computer. In other embodiments, the alarm may be only a visual alarm or only an aural alarm.

Although the illustrated alarm system 150 is configured to determine the angle through which the head section 40 is raised relative to the base frame 28 of the bed 20 and then activate the alarm 154 when the determined head-of-bed angle is less than or equal to a threshold angle, the alarm system 150 may instead be configured to determine the angle through which some other deck section, such as the thigh section 44, is raised relative to the base frame 28 or relative to some other portion of bed 20, and activate the alarm 154 when the determined angle is greater than, greater than or equal to, less than, or less than or equal to than the threshold angle. Alternatively or additionally, system 150 may determine an angle through which multiple deck sections are raised relative to other portions of the bed and activate the alarm 154 when the determined angle violates the programmed logic condition. For example, system 150 may determine whether the sum of the angles that the head section 40 and thigh section 44 are raised is greater than a threshold angle and activate alarm 158 accordingly.

Figure 6:
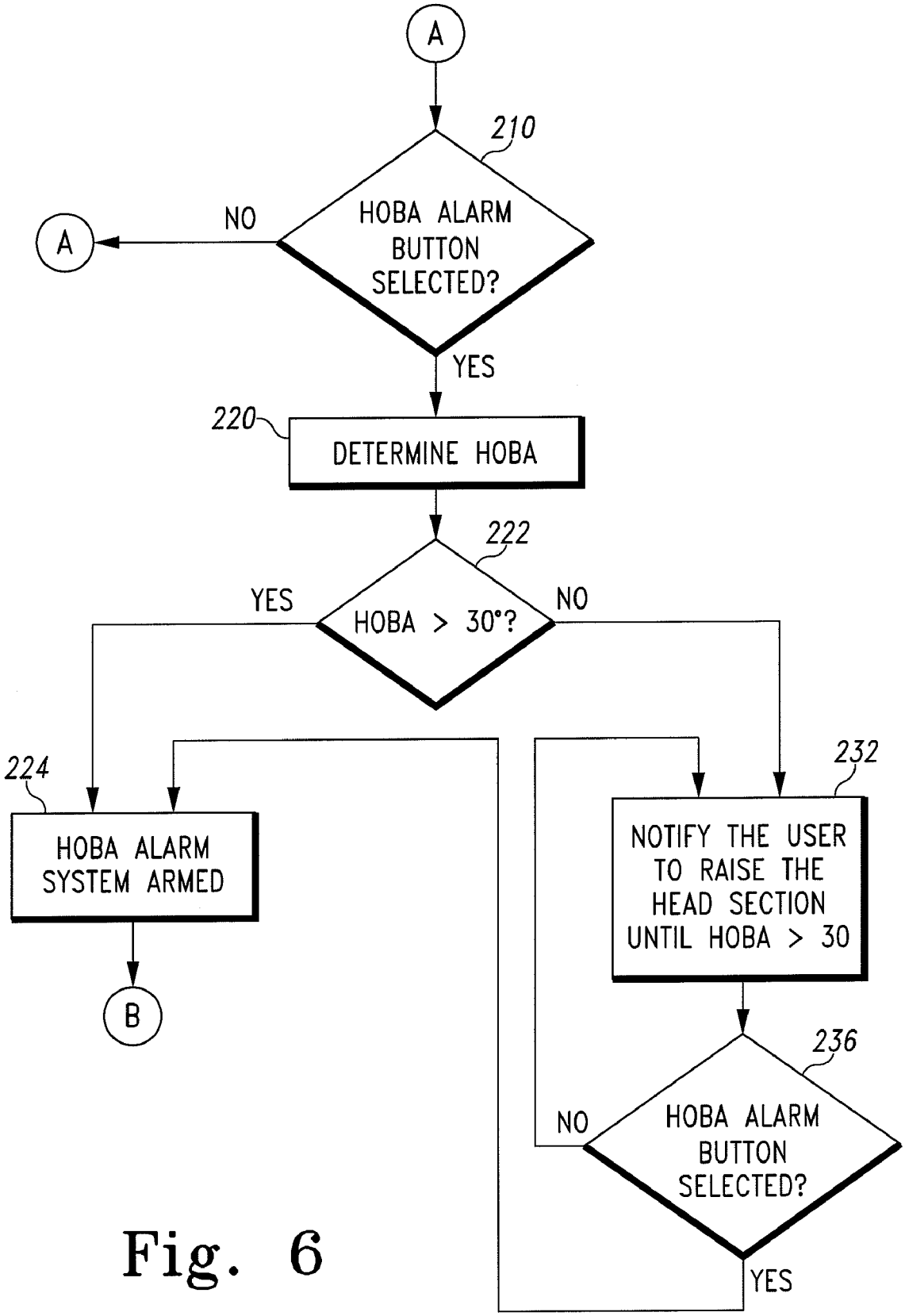
FIGS. 6 and 7 are flow charts showing an algorithm executed by a microprocessor in the controller to arm the head-of-bed angle alarm system, to determine if the head-of-bed angle is below a threshold angle, and to activate the head-of-bed angle alarm when the head-of-bed angle is below the threshold angle.
Figure 7:
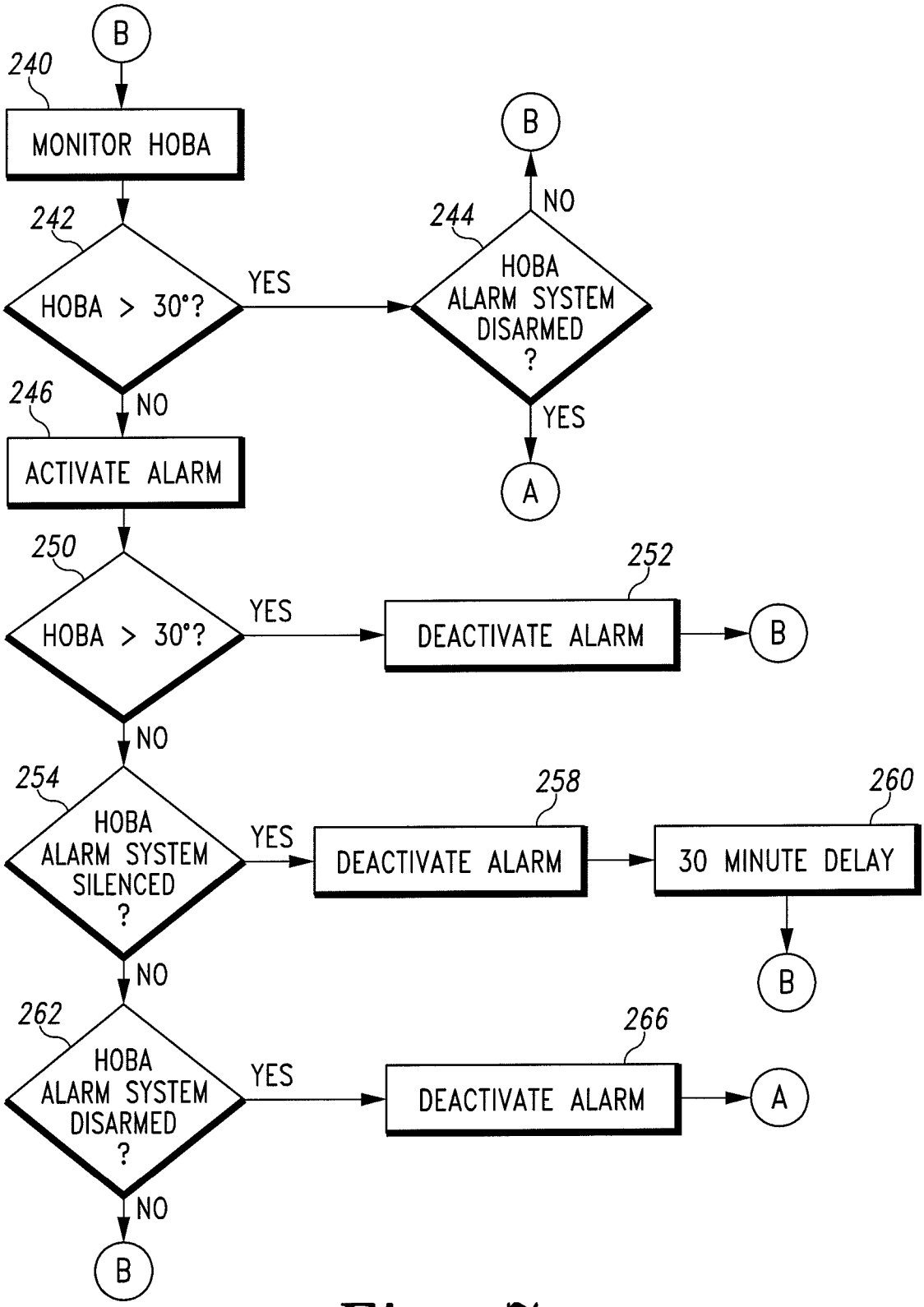

FIGS. 6 and 7 are flow charts of an algorithm executed by one or more microprocessors associated with the controller 132 to arm the alarm system 150 when the head-of-bed angle is above the threshold angle, to monitor the head-of-bed angle, and to activate the alarm 154 when the head-of-bed angle is less than or equal to the threshold angle. In the illustrated embodiment, the threshold angle is set at 30°. However, the threshold angle may be either fixed or selected by the caregiver using the threshold angle selector 156 as discussed above. In the illustrated embodiment, the alarm 154 is activated when the head-of-bed angle is less than or equal to the threshold angle. However, the controller 132 may very well be programmed to activate the alarm 154 when the current head-of-bed angle is greater than the threshold angle, greater than or equal to the threshold angle, less than or less than or equal to the threshold angle, outside first and second threshold angles, or inside first and second threshold angles, etc.

In the particular embodiment shown in FIGS. 6 and 7, when alarm system 150 is armed, the controller 132 will activate the alarm 154 when the head-of-bed angle is less than or equal to the threshold angle. Also, examples of activation of alarm 154 include turning on a flashing light, producing a sound, displaying a message box on the screen 118 of the GCI 94, turning on a dome light of a nurse call system, etc., as the case may be.

Referring to FIG. 6, the controller 132, at step 210, checks to see if the alarm on/off button 158 is selected by a caregiver.

The caregiver may select the alarm on/off button 158 on the home screen 200 shown in FIG. 8 to arm the alarm system 150 via appropriate use of the controls 120 of GCI 94. To select the alarm on/off button 158, the caregiver moves the cursor (the "cursor" here refers to the portion of the display screen that is highlighted) over the text adjacent to the alarm on/off button 158 by using the up and down scroll arrows of controls 120 and then presses the enter button of controls 120 on the GCI 94 of the bed 20. When the cursor is over the alarm on/off button 158, the head-of-bed-angle-greater-than-30° statistics 212 are displayed on the left side 214 of the home screen 200. In the particular example shown in FIG. 8, the head-of-bed angle has been greater than 30° for a total of 13 hours and 29 minutes since 12 AM on that day.

Figure 9:
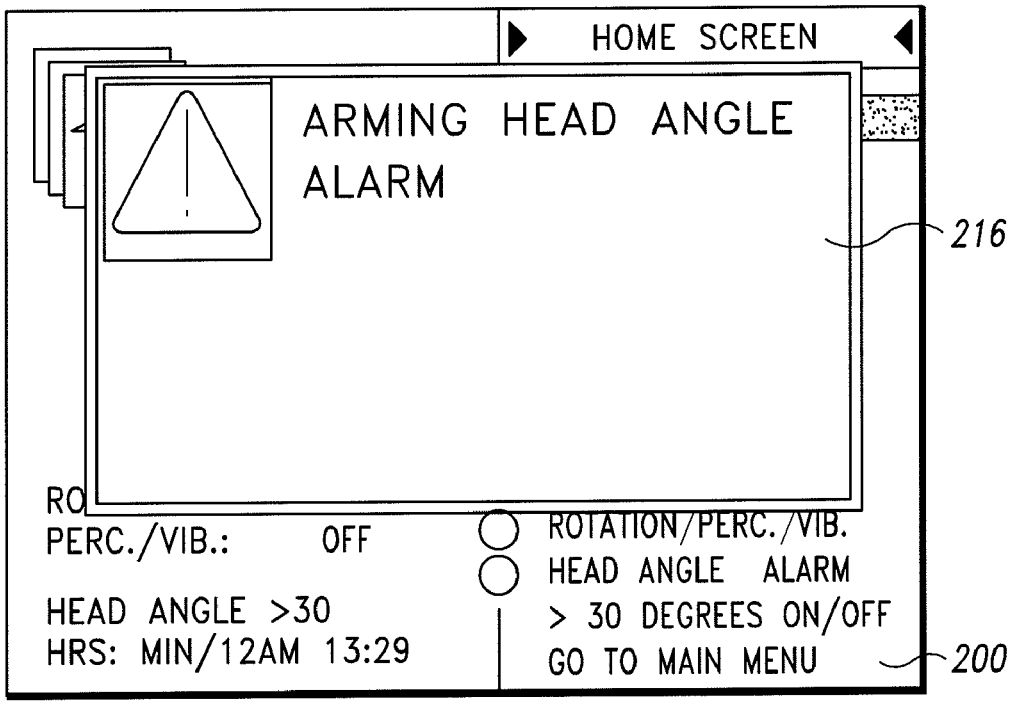
FIG. 9 is a screen shot of a pop-up box that appears on the home screen of the GCI in response to a user input to arm the head-of-bed angle alarm system.

If the caregiver has not selected the alarm on/off button 158, the controller 132 continues to monitor the alarm on/off button 158 at step 210. Those skilled in the art will appreciate that controller 132 may perform other tasks and therefore, the monitoring of system 150 at step 210 may not be continuous, but rather may occur from time-to-time. Those skilled in the art will also appreciate that microcontroller 132 may receive one ore more interrupts from GCI 94 to indicate that a user has manipulated controls 120 to arm system 150. If the alarm on/off button 158 is selected by the caregiver, a message box 216 shown in FIG. 9 briefly appears on the home screen 200 to inform the caregiver that the alarm system 150 is being armed. At step 220, the controller 132 determines the current head-of-bed angle based on data from the angle sensor 152 and angle sensors which measure the tilt of frame 28 relative to frame 24. At step 222, the controller 132 compares the current head-of-bed angle with the threshold angle of 30°. If the current head-of-bed angle is greater than the threshold angle of 30°, the alarm system 150 is armed as indicated at step 224.

Figure 10:
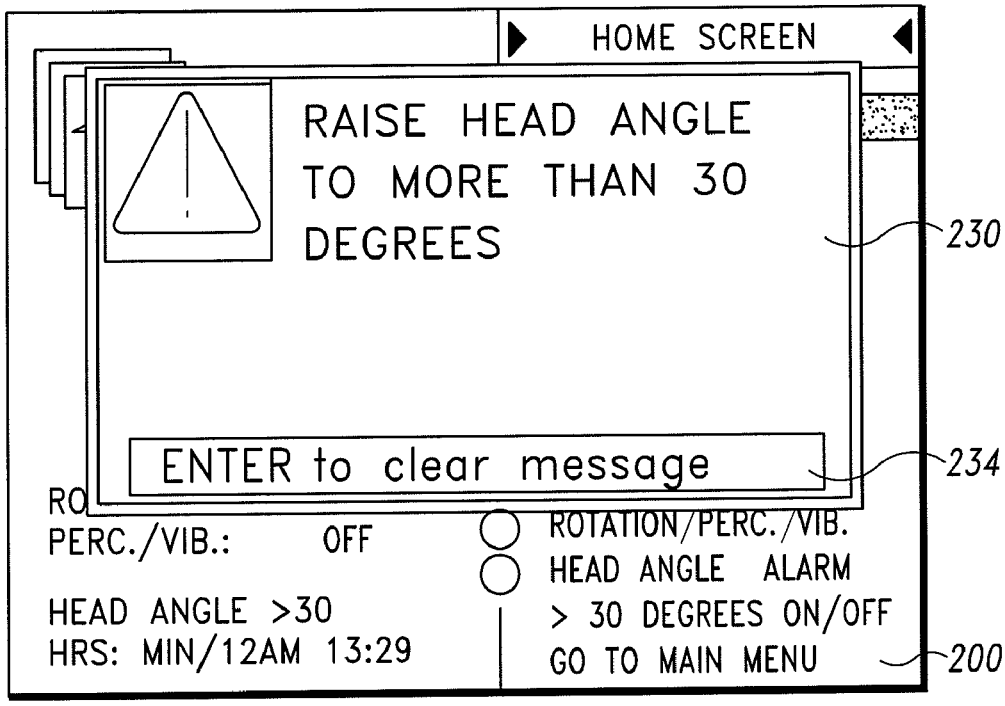
FIG. 10 is a screen shot of a pop-up box that appears on the home screen of the GCI if an attempt is made to arm the head-angle-alarm system but the head angle is less than the threshold angle.

If the current head-of-bed angle is not greater than the threshold angle of 30°, a message box 230 shown in FIG. 10 appears as indicated at step 232 instructing the caregiver to raise the head section 40 to an inclination at which the head-of-bed angle is more than 30°. The message box 230 includes an instruction 234 telling the caregiver to press the enter button 120 on the GCI 94 of the bed 20 should the caregiver decide not arm the alarm system 150. If the caregiver selects the enter button 120 at this point, the message box 230 on the home screen 200 will disappear and the alarm system 150 will not be armed.

If the caregiver does not select the enter button 120, the controller 132 will continue to display the message box 230 on the home screen 200 until the caregiver raises the head section 40 to an inclination at which the head-of-bed angle is more than 30°. When the caregiver raises the head section 40 to an inclination at which the head-of-bed angle is more than 30°, the message box 230 on the home screen 200 disappears. When the message box 230 disappears, the caregiver can select the alarm on/off button 158 to arm the alarm system 150 via appropriate manipulations of controls 120.

The controller 132, at step 236, checks to see if the alarm on/off button 158 is selected by a caregiver. If the caregiver selects the alarm on/off button 158, the message box 230 shown in FIG. 10 disappears from the home screen 200 and the message box 216 shown in FIG. 9 briefly reappears on the home screen 200 informing the caregiver that the alarm system 150 is being armed. The controller 132 returns to step 224 to arm the alarm system 150. If the caregiver does not select the alarm on/off button 158, the controller 132 will continue to display the message box 230. In some embodiments, a time out may occur after a preprogrammed amount of time without any head section adjustment to raise the head section 40 above 30° or if the user does not manipulate any of controls 120 to select button 158 and/or indicate that system 150 should be armed after head section 40 is raised about 30°. If a timeout occurs, the algorithm returns to step 210.

Referring now to FIG. 7, when the alarm system 150 is armed, the controller 132 at step 240 monitors the current head-of-bed angle. At step 242, the controller 132 checks to see if the current head-of-bed angle is greater than the threshold angle of 30°. If the current head-of-bed angle is greater than the threshold angle of 30°, the controller 132 at step 244 checks to see if the alarm system 150 is disarmed. If the alarm system 150 is disarmed, the controller 132 returns to step 210 in FIG. 6 to await further instructions from the caregiver. If, on the other hand, the alarm system 150 is not disarmed, the controller 132 returns to step 240 to continue to monitor the head-of-bed angle.

If the current head-of-bed angle is not greater than the threshold angle of 30°, the alarm 154 is activated at step 246. When the alarm 154 is activated, in addition to displaying a message box 248 (FIG. 11) on the home screen 200, the controller 132 may be configured to sound of an aural alarm, activate a flashing light, or activate a dome light of a nurse call system. The message box 248 instructs the caregiver to raise the head section 40 to an inclination at which the head-of-bed angle is greater than the threshold angle of 30°. The controller 132 may be programmed to cause the message box 248 to flash to draw the caregiver's attention to the alarm condition.

At step 250, the controller 132 checks to see if the current head-of-bed angle is greater than the threshold angle of 30°. If the caregiver raises the head section 40 so that the head-of-bed angle is greater than the threshold angle of 30°, the controller 132 deactivates the alarm 154 at step 252 and the message box 248 instructing the caregiver to raise the head section 40 disappears. The controller 132 returns to step 240 to continue to monitor the head-of-bed angle. The alarm system 150 remains armed.

At step 254, the controller 132 checks to see if the alarm system 150 is silenced. The caregiver may silence the alarm system 150 for a set period, such as 30 minutes, without disarming the alarm system 150 by selecting a silence button 256 on the message box 248 in FIG. 11. To select the silence button 256, the caregiver moves the cursor over the silence button 256 by using the up and down scroll arrows and then presses the enter button on the GCI 94. The controller 132 may be configured to allow the caregiver to set the delay period. If the alarm system 150 is silenced, the controller 132 deactivates the alarm 154 at step 258. The alarm 154 remains deactivated for a set period, such as 30 minutes, as indicated by step 260. Thereafter, the controller 132 returns to step 240 to monitor the head-of-bed angle.

If the alarm system 150 is not silenced at step 254, the algorithm proceeds to step 262. At step 262, the controller 132 checks to see if the alarm system 150 is disarmed. The caregiver may disarm the alarm system by selecting a head-of-bed angle alarm off button 264 on the message box 248 in FIG. 11. To select the alarm off button 264, the caregiver moves the cursor over the alarm off button 264 by using the up and down scroll arrows and then presses the enter button on the GCI 94. If the alarm system 150 is disarmed, the controller 132 deactivates the alarm 154 at step 266 and the controller 132 returns to step 210 in FIG. 6. If the alarm system 150 is not disarmed, the controller 132 returns to step 240 to monitor the head-of-bed angle.

In addition to displaying head-of-bed-angle statistics 212 for that particular day as shown in FIG. 8, the alarm system 150 is configured to display head-of-bed-angle statistics 280, 282 for the previous eight days as shown in FIGS. 14 and 15.

Figure 12:
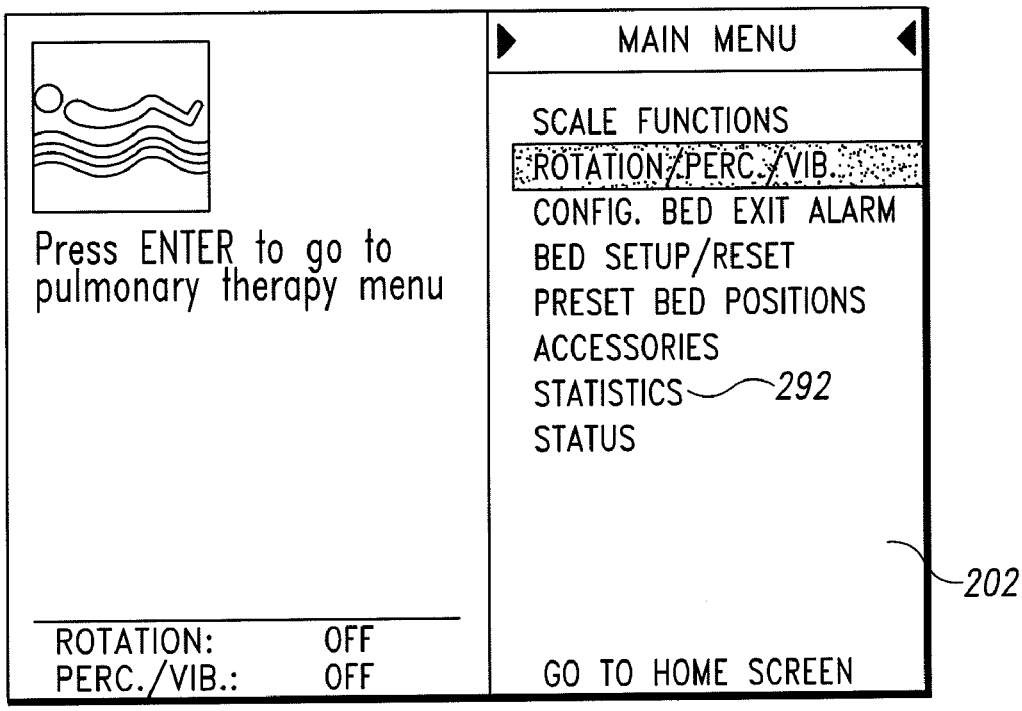
FIG. 12 is a screen shot of a main menu screen that appears on the GCI in response to appropriate user inputs, the main menu having a statistics option.

To this end, the caregiver selects a main menu button 290 on the home screen 200. To select the main menu button 290, the caregiver moves the cursor over the main menu button 290 by using the up and down scroll arrows and then presses the enter button on the GCI 94. When the caregiver selects the main menu button 290, a main menu screen 202 appears on the GCI 94 of the bed 20 as shown in FIG. 12. The caregiver then selects a statistics button 292 on the main menu screen 202. To select the statistics button 292, the caregiver moves the cursor over the statistics button 292 by using the up and down scroll arrows and then presses the enter button on the GCI 94.

Figure 13:
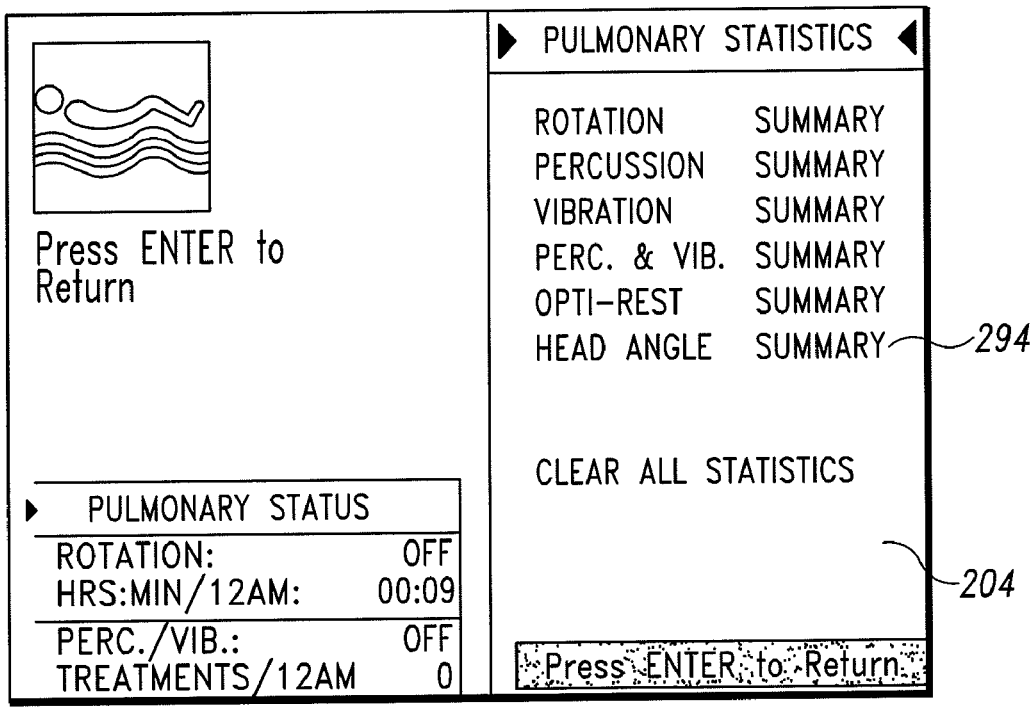
FIG. 13 is a screen shot of a pulmonary statistics screen that appears on the GCI in response to appropriate user inputs to select the statistics option of the main menu, the pulmonary statistics screen having a head angle summary option.

When the caregiver selects the statistics button 292, a pulmonary statistics screen 204 appears on the GCI 94 as shown in FIG. 13. The caregiver then selects a head angle summary button 294 on the statistics screen 204. To select the head angle summary button 294, the caregiver moves the cursor over the head angle summary button 294 by using the up and down scroll arrows and then presses the enter button on the GCI 94. When the caregiver selects the head angle summary button 294, head-of-bed-angle statistics 280, 282 for the previous eight days appear on the GCI 94 as shown in FIGS. 14 and 15.

The format for the head-of-bed-angle statistics 260, 262 for the previous eight days is similar to the format for the head-of-bed-angle statistics 212 for the particular day. Thus, in the particular example shown in FIG. 14, 1) the first line 296 states that on the previous day, Jan. 28, 2005, the head-of-bed angle has been greater than 30° for a total of 13 hours and 19 minutes, 2) the second line 298 states that on Jan. 27, 2005, the head-of-bed angle has been greater than 30° for a total of 12 hours and 45 minutes, 3) the third line 300 states that on Jan. 26, 2005, the head-of-bed angle has been greater than 30° for a total of 21 hours and 34 minutes, and 4) the fourth line 302 states that on Jan. 25, 2005, the head-of-bed angle has been greater than 30° for a total of 4 hours and 56 minutes. On the other hand, in FIG. 15, 1) the first line 304 states that on Jan. 24, 2005, the head-of-bed angle has been greater than 30° for a total of 9 hours and 47 minutes, 2) the second line 306 states that on Jan. 23, 2005, the head-of-bed angle has been greater than 30° for a total of 22 hours and 21 minutes, 3) the third line 308 states that on Jan. 22, 2005, the head-of-bed angle has been greater than 30° for a total of 13 hours and 23 minutes, and 4) the fourth line 310 states that on Jan. 21, 2005, the head-of-bed angle has been greater than 30° for a total of 11 hours and 6 minutes.

Figure 16:
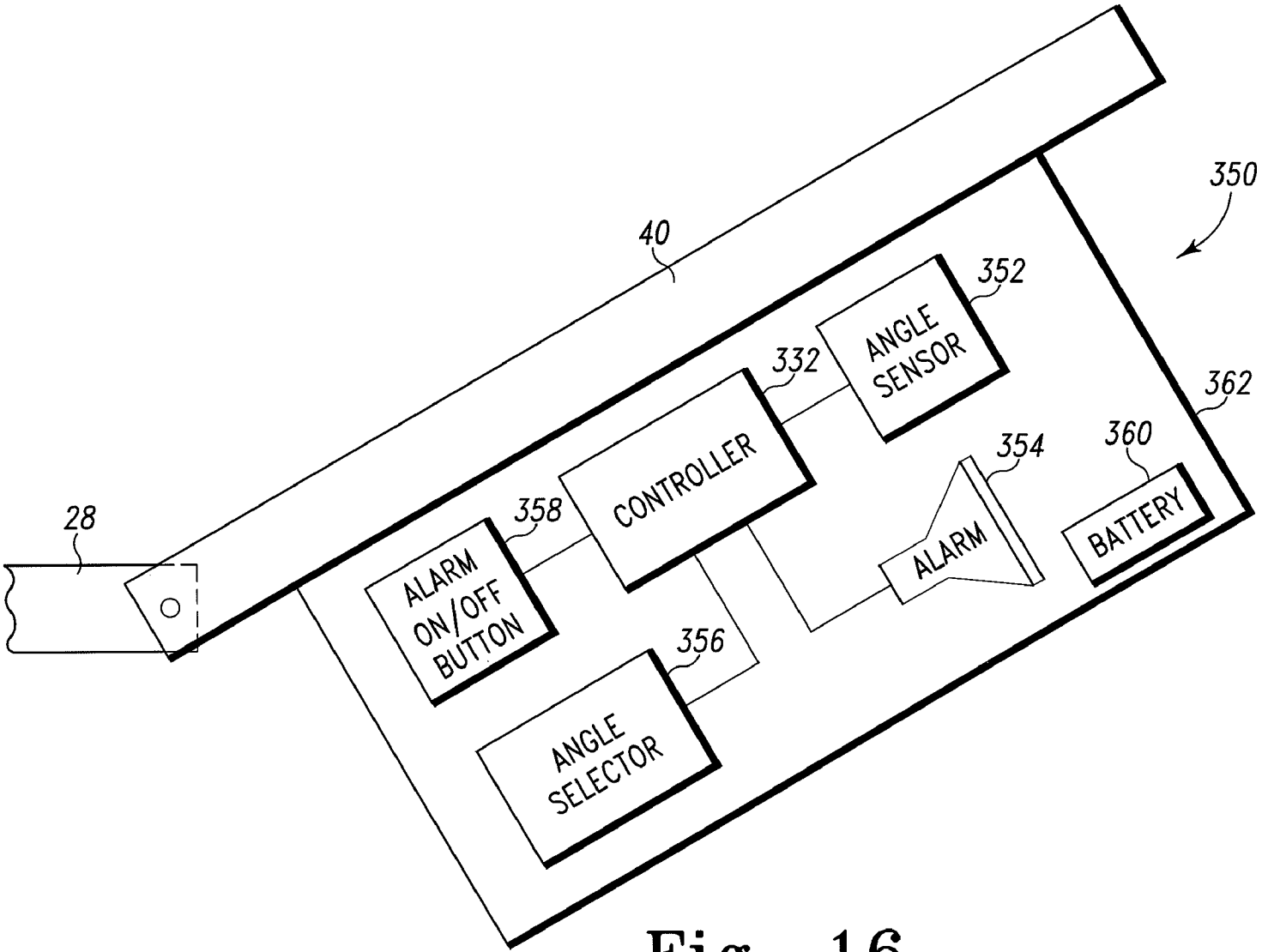
FIG. 16 is a block diagram showing components of a second embodiment of the head-of-bed angle alarm system mounted to an underside of the head section for angular movement therewith relative to the intermediate frame, the system including a head-of-bed angle sensor operable to determine an angular position of the head section, a head-of-bed angle alarm, a threshold angle selector, an alarm on/off button, and a controller coupled to the sensor, the head-of-bed angle alarm, the threshold angle selector and the alarm on/off button.

FIG. 16 diagrammatically shows a second embodiment of a head-of-bed alarm system 350. Portions of the alarm system 350 are substantially the same as like portions of the alarm system 150. Therefore, like reference numerals are used, where appropriate, to denote portions of the alarm system 350 that are substantially similar to like portions of the alarm system 150. In the illustrated embodiment, the alarm system 350 is mounted to an underside of the head section 40 for movement therewith relative to the intermediate frame 28. The alarm system 350 may be coupled to any suitable portion of the head section 40, such as, for example, a frame member, a deck panel, or a siderail that moves along with head section 40. The head section 40 is diagrammatically shown in FIG. 16 to pivot relative to the intermediate frame 28 about a simple pivot axis. However, system 350 may be mounted to head sections having all types of pivots such as those listed above in this disclosure.

The alarm system 350 includes an angle sensor 352 operable to determine an angular position of the head section 40 relative to the intermediate frame 28, a head-of-bed angle alarm 354, a threshold angle selector 356, an alarm on/off button 358, and a controller 332 coupled to each of the angle sensor 352, the alarm 354, the threshold angle selector 356, and the alarm on/off button 358. A battery 360 provides power to various components of the alarm system 350. The alarm system 350 is enclosed in a housing 362 that attaches to the head section 40 by one or more suitable fasteners such as screws, bolts, pins, fingers, latches, locks, straps, bands, adhesive, magnets, tongues, grooves, slots, flanges, brackets, clasps, clips, and rivets, just to name a few.

The operation of the alarm system 350 is generally similar to the operation of the alarm system 150. The alarm system 350 activates the alarm 354 when the head section 40 is below or at a user-selected threshold angle. In embodiments where the threshold angle is fixed (e.g., 30°), the threshold angle selector 356 may be omitted. In some such embodiments, the value of the fixed head-of-bed threshold angle is stored in a memory associated with the controller 332. In the illustrated embodiment, the angle sensor 352 provides an electrical signal to the controller 332 that corresponds to the current head-of-bed angle. The controller 332 compares the current head-of-bed angle with the user-selected threshold angle and activates the alarm 354 when the head section 40 is below or at the user-selected threshold angle.

Those skilled in the art will appreciate that the present disclosure is not limited to the use of any particular type of angle sensor, and that many equivalent forms of measuring incline and decline of the head section 40 may be used in the alarm system 350, such as a ball switch, an electronic bubble gauge, an inclinometer, an accelerometer, a gyroscope, and the like. In alternative embodiments, the controller 332 and the angle selector 356 may be omitted. In such embodiments, the angle sensor 352 may be a switch that opens and closes at a threshold angle such as a ball switch and that is directly coupled to the alarm 354 to permit application of voltage to the alarm when the switch closes. Depending upon the type of switch chosen and the design of the circuitry of system 350, the alarm 354 is activated when the head section 40 is above, above or at, below, or below or at a fixed threshold angle.

Thus, a method is disclosed for activating an alarm when an angular position of a deck section coupled to a frame of a patient support apparatus is greater than, greater than or equal to, less than, or less than or equal to a threshold angle as the deck section moves between first and second angular positions relative to the frame. The method comprises the steps of: sensing the deck section angle, comparing the deck section angle to the threshold angle, and activating the alarm when the deck section angle is greater than, greater than or equal to, less than, or less than or equal to the threshold angle. In the illustrated embodiments, however, the deck section is the head section 40.

Although certain illustrative embodiments have been described in detail above, variations and modifications exist within the scope and spirit of this disclosure as described and as defined in the following claims.

The invention claimed is:

1. A person support apparatus comprising:

a frame, a deck section coupled to the frame and movable relative to the frame between first and second angular positions, the deck section being configured to support at least a portion of a mattress, a sensor coupled to the deck section and operable to provide a sensor signal indicative of an angular position of the deck section, an alarm, and a controller coupled to the sensor and the alarm, the controller being configured to arm and disarm the alarm in response to an input signal from at least one user input, the controller being configured to permit the alarm to be armed only if the angular position of the deck section is above a threshold angle and to activate the alarm if the alarm is armed and the angular position of the deck section is below the threshold angle, the controller being configured such that the activation of the alarm due to the deck section being below the threshold angle occurring, when the alarm is alarmed, irrespective of whether a mattress is present on the deck section and, if a mattress is present on the deck section, irrespective of the type of mattress that is present.

2. The apparatus of claim 1, wherein the sensor comprises a rotary potentiometer having a rotary member coupled to the deck section for rotation therewith.

3. The apparatus of claim 1, wherein the sensor comprises an inclinometer coupled to the deck section for movement therewith.

4. The apparatus of claim 3, wherein the inclinometer is secured to an underside of the deck section.

5. The apparatus of claim 1, wherein the sensor comprises a limit switch coupled to the controller, and the limit switch signals the controller to activate the alarm if the deck section is below the threshold angle.

6. The apparatus of claim 1, further comprising an actuator coupled to the deck section and operable to move the deck section relative to the frame between the first and second angular positions.

7. The apparatus of claim 6, wherein the actuator comprises a hydraulic actuator.

8. The apparatus of claim 6, wherein the actuator comprises a motor having a drive shaft, and the sensor comprises a shaft encoder to determine the amount of rotation of the drive shaft as the deck section is moved between the first and second angular positions.

9. The apparatus of claim 1, wherein the alarm is normally off and the at least one user input comprises an on/off button coupled to the controller for arming and disarming the alarm.

10. The apparatus of claim 9, wherein the alarm on/off button is located on a graphical caregiver interface of the patient support apparatus.

11. The apparatus of claim 10, wherein the graphical caregiver interface is located on an outboard side of a siderail of the patient support apparatus.

12. The apparatus of claim 9, wherein the alarm on/off button is located on a frame member of the patient support apparatus.

13. The apparatus of claim 9, wherein the alarm on/off button is operable from a remote nurse control station.

14. The apparatus of claim 1, wherein the threshold angle is fixed and is stored in a memory associated with the controller.

15. The apparatus of claim 1, wherein the threshold angle is selectable between first and second threshold angles.

16. The apparatus of claim 15, wherein the threshold angle is selectable using a graphical caregiver interface of the patient support apparatus.

17. The apparatus of claim 16, wherein the graphical caregiver interface is located on an outboard side of a siderail of the patient support apparatus.

18. The apparatus of claim 15, wherein the threshold angle is selectable using a threshold angle selector located on a frame member of the patient support apparatus.

19. The apparatus of claim 1, wherein the alarm is aural and located on the patient support apparatus.

20. The apparatus of claim 1, wherein the alarm is visual.

21. The apparatus of claim 20, wherein the visual alarm is in the form of a flashing icon on a graphical caregiver interface of the patient support apparatus.

22. The apparatus of claim 20, wherein the visual alarm is in the form of a flashing light located near a doorway of a hospital room in which the patient support apparatus is located.

23. The apparatus of claim 1, wherein the controller compares data corresponding to the deck section angular position detected by the sensor to data corresponding to the threshold angle and activates the alarm if the data corresponding to the deck section angular position is less than the data corresponding to the threshold angle.

24. The apparatus of claim 1, wherein the deck section comprises a head section of a patient support deck.

25. A method for activating an alarm if an angular position of a deck section coupled to a frame of a person support apparatus is below a threshold angle as the deck section moves between first and second angular positions relative to the frame, the deck section being configured to support at least a portion of a mattress, the method comprising:

sensing the angular position of the deck section with a sensor that is coupled to the deck section and that is coupled to a controller of the apparatus, comparing, using the controller, the deck section angular position to the threshold angle, permitting the alarm to be armed by the controller in response to an input signal from at least one user input only if the angular position of the deck section is above the threshold angle, and activating the alarm if the alarm is armed and the deck section angular position is below the threshold angle, the controller signaling the activation of the alarm due to the deck section being below the threshold angle, when the alarm is armed, irrespective of whether a mattress is present on the deck section and, if a mattress is present on the deck section, irrespective of functions included in the mattress that is present.

26. The method of claim 25, further comprising selecting the threshold angle using a graphical caregiver interface of the patient support apparatus.

27. The method of claim 25, wherein the comparing step comprises comparing data corresponding to the deck section angular position to data corresponding to the threshold angle.

28. The method of claim 25, further comprising instructing the user to raise the deck section above the threshold angle if the user attempts to arm the alarm while the angular position of the deck section is below the threshold angle.

29. The patient support apparatus of claim 1, wherein the controller includes a display having a home screen.

30. The patient support apparatus of claim 29, wherein the home screen has a menu including a radio button which indicates whether the alarm is armed or disarmed.

31. The patient support apparatus of claim 29, wherein the controller is configured to generate a pop-up box on the home screen indicating that the alarm is being armed in response to receipt of the input signal to arm the alarm.

32. The patient support apparatus of claim 29, wherein the controller is configured to generate a pop-up box on the home screen instructing the user to raise the deck section above the threshold angle if an attempt is made to arm the alarm but the angular position of the deck section is below the threshold angle.

33. The patient support apparatus of claim 29, wherein the controller is configured to generate a pop-up box on the home screen that serves as a visual alarm if the alarm is armed and the deck section is lowered below the threshold angle.

34. The patient support apparatus of claim 29, wherein the controller is configured to generate a main menu screen having a statistics button on the display in response to the user selecting a main menu button on the home screen.

35. The patient support apparatus of claim 34, wherein the controller is configured to generate a pulmonary statistics screen having a deck section angle summary button on the display in response to the user selecting the statistics button on the main menu screen.

36. The patient support apparatus of claim 35, wherein the controller is configured to generate summary statistics for at least one day on the display screen in response to the user inputs selecting the deck section angle summary button on the pulmonary statistics screen.

* * * * *